US011373773B2

(12) United States Patent
Sisley et al.

(10) Patent No.: US 11,373,773 B2
(45) Date of Patent: Jun. 28, 2022

(54) METHOD FOR MAKING CONTAINMENT CASK FOR DRUM CONTAINING RADIOACTIVE HAZARDOUS WASTE

(71) Applicant: NAC International Inc., Norcross, GA (US)

(72) Inventors: Steve E. Sisley, Peachtree Corners, GA (US); Andrew K. Langston, Wilmington, NC (US); Juan C. Subiry, Atlanta, GA (US)

(73) Assignee: NAC INTERNATIONAL INC., Norcross, GA (US)

( * ) Notice: Subject to any disclaimer, the term of this patent is extended or adjusted under 35 U.S.C. 154(b) by 117 days.

(21) Appl. No.: 17/147,368

(22) Filed: Jan. 12, 2021

(65) Prior Publication Data

US 2021/0280331 A1 Sep. 9, 2021

Related U.S. Application Data

(62) Division of application No. 16/117,510, filed on Aug. 30, 2018, now abandoned.

(Continued)

(51) Int. Cl.

| | |
|---|---|
| ***G21F 5/005*** | (2006.01) |
| ***G21F 5/12*** | (2006.01) |
| ***G21F 5/08*** | (2006.01) |

(52) U.S. Cl.

CPC ..... *G21F 5/005* (2013.01); *G21F 5/08* (2013.01); *G21F 5/12* (2013.01)

(58) Field of Classification Search

CPC ... G21F 5/005; G21F 5/08; G21F 5/12; G21F 5/002; G21F 5/008; G21F 5/012;

(Continued)

(56) References Cited

U.S. PATENT DOCUMENTS

| | | | |
|---|---|---|---|
| 3,886,368 | A | 5/1975 | Rollins et al. |
| 3,982,134 | A | 9/1976 | Housholder et al. |

(Continued)

FOREIGN PATENT DOCUMENTS

| | | | |
|---|---|---|---|
| EP | 0036954 | A1 | 10/1981 |
| EP | 1205940 | A1 | 5/2002 |
| EP | 1293451 | A1 | 8/2002 |

OTHER PUBLICATIONS

Supplementary European Search Report in co-pending related EP Application No. 18849818.2 dated Apr. 30, 2021.

(Continued)

*Primary Examiner* — Andrew D Perreault

(74) *Attorney, Agent, or Firm* — Thomas | Horstemeyer, LLP

(57) ABSTRACT

A containment cask is disclosed for safely transporting and storing radioactive hazardous waste in a dry air environment. The cask comprises a single drum containing the radioactive hazardous waste, a sealed and shielded containment vessel containing the drum, and an outer container. The outer container can be in the form of an outer shield vessel (OSV) made from iron to provide further shielding. This outer container is appropriate for a drum having higher activity waste. The outer container can also be in the form of an overpack assembly that adds protection for atmospheric hazards, but adds little in terms of shielding. This outer container is appropriate for a drum having lower activity waste.

20 Claims, 11 Drawing Sheets

Related U.S. Application Data

(60) Provisional application No. 62/552,726, filed on Aug. 31, 2017.

(58) Field of Classification Search
CPC ... G21F 5/015; G21F 5/02; G21F 5/04; G21F 5/06; G21F 5/065; G21F 5/14; B65D 7/22; B65D 90/028
USPC ..... 220/560.1; 206/408; 376/272; 108/55.1, 108/55.3, 57.13
See application file for complete search history.

(56) References Cited

U.S. PATENT DOCUMENTS

| | | | |
|---|---|---|---|
| 4,366,095 | A | 12/1982 | Takats et al. |
| 4,456,827 | A | 6/1984 | Botzem et al. |
| 4,599,518 | A | 7/1986 | Schmidt |
| 5,394,449 | A | 2/1995 | Johnson |
| 6,489,623 | B1 | 12/2002 | Peters |
| 8,923,470 | B2 | 12/2014 | Convert |
| 9,218,897 | B1 | 12/2015 | Braun |
| 9,396,824 | B2 | 7/2016 | Agace |
| 2003/0010938 | A1 | 1/2003 | Michels et al. |
| 2008/0073601 | A1 | 3/2008 | Temus et al. |
| 2016/0196887 | A1 | 2/2016 | Singh |
| 2018/0005717 | A1 | 1/2018 | Singh et al. |
| 2018/0322970 | A1 | 11/2018 | Singh et al. |

OTHER PUBLICATIONS

IPRP in co-pending, related PCT Application No. PCT/US2018/49026, dated Jan. 8, 2019.

International Search Report and Written Opinion in co-pending, related PCT Application No. PCT/US2018/49026, dated Jan. 8, 2019.

55g Drum

85g Drum

110g Drum

METHOD FOR MAKING CONTAINMENT CASK FOR DRUM CONTAINING RADIOACTIVE HAZARDOUS WASTE

CLAIM OF PRIORITY

This application is a divisional of and claims priority to U.S. application Ser. No. 16/117,510, filed Aug. 30, 2018, which application claims priority to and the benefit of provisional application No. 62/552,726, filed Aug. 31, 2017, which are both incorporated herein by reference in their entireties.

FIELD OF THE INVENTION

The embodiments of the present disclosure generally relate to safely transporting and storing drums that contain radioactive hazardous waste.

BACKGROUND

There is a need for an inexpensive transportation and storage containment cask for a small modular Type B fissile waste that is capable of shipping and storing at least the following contents: (a) DOE-EM legacy wastes, including contact-handled (CH) and remote-handled (RH) TRU wastes in U.S. standard 55-gal, 85-gal and 110-gal drums and other containers of similar or smaller dimensions; and (b) Canada deuterium uranium (CANDU) spent fuel in basket configurations from the Atomic Energy of Canada Limited (AECL) facilities.

Any such containment cask must follow the extensive applicable regulations for the transport and storage of fissile and radioactive contents in the U.S. and Canada.

SUMMARY OF THE INVENTION

Embodiments of containment casks (and methods making same) are provided for safely transporting and storing drums that contain radioactive hazardous waste.

One embodiment, among others, is a containment cask for safely transporting and storing radioactive hazardous waste in a dry air environment. The cask comprises a single drum containing the radioactive hazardous waste, a sealed and shielded containment vessel containing the drum, and an outer container.

The outer container can take a plurality of forms. It can be in the form of an outer shield vessel (OSV) made from iron to provide further shielding. This outer container is appropriate for a drum having higher activity waste. The outer container can also be in the form of an overpack assembly that adds protection for hypothetical accident conditions (e.g., free drop, puncture, and fire), but adds little in terms of shielding. This outer container is appropriate for a drum having lower activity waste.

Another embodiment, among others, is a method for providing, designing, and/or constructing a containment cask for safely transporting and storing radioactive hazardous waste. The method comprises:

(a) providing, designing, and/or constructing a common containment vessel (CCV), the CCV having an elongated cylindrical body extending between a top end and a bottom end, the body having an elongated cylindrical side wall, a circular planar bottom plate mounted to the side wall at the bottom end, and a circular planar lid mounted to the side wall at the top end, wherein the body defines an interior region that contains a single drum containing the radioactive hazardous waste and provides shielding to inhibit radiation emitted from the single drum;

(b) providing, designing, and/or constructing an outer shield vessel (OSV), the OSV having an elongated cylindrical body extending between a top end and a bottom end, the body having an elongated cylindrical side wall, a circular planar bottom plate mounted to the side wall at the bottom end, and a circular planar lid mounted to the side wall at the top end, wherein the body defines an interior region that can contain the CCV having the single drum containing the radioactive hazardous waste, the OSV comprising supplemental shielding designed to reduce the external radiation dose rates from the radioactive hazardous waste within the drum, the supplemental shielding comprising ductile cast iron;

(c) providing, designing, and/or constructing an overpack assembly, the overpack assembly being lighter in weight than the OSV, the overpack assembly having an elongated cylindrical body extending between a top end and a bottom end, the body having an elongated cylindrical side wall, a circular planar bottom plate mounted to the side wall at the bottom end, and a circular planar lid mounted to the side wall at the top end, wherein the body defines an interior region that contains the CCV having the single drum containing the radioactive hazardous waste, the overpack assembly having shielding inserts that inhibit nuclear radiation, the inserts enabling flexibility in terms of a degree of shielding;

(d) selecting either the OSV or overpack assembly for use in combination with the CCV in order to create the containment cask, based at least in part upon the radioactive hazardous waste contained within the single drum.

Other vessels, apparatus, methods, apparatus, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

A. First Embodiment of Containment Cask

Figure 1:
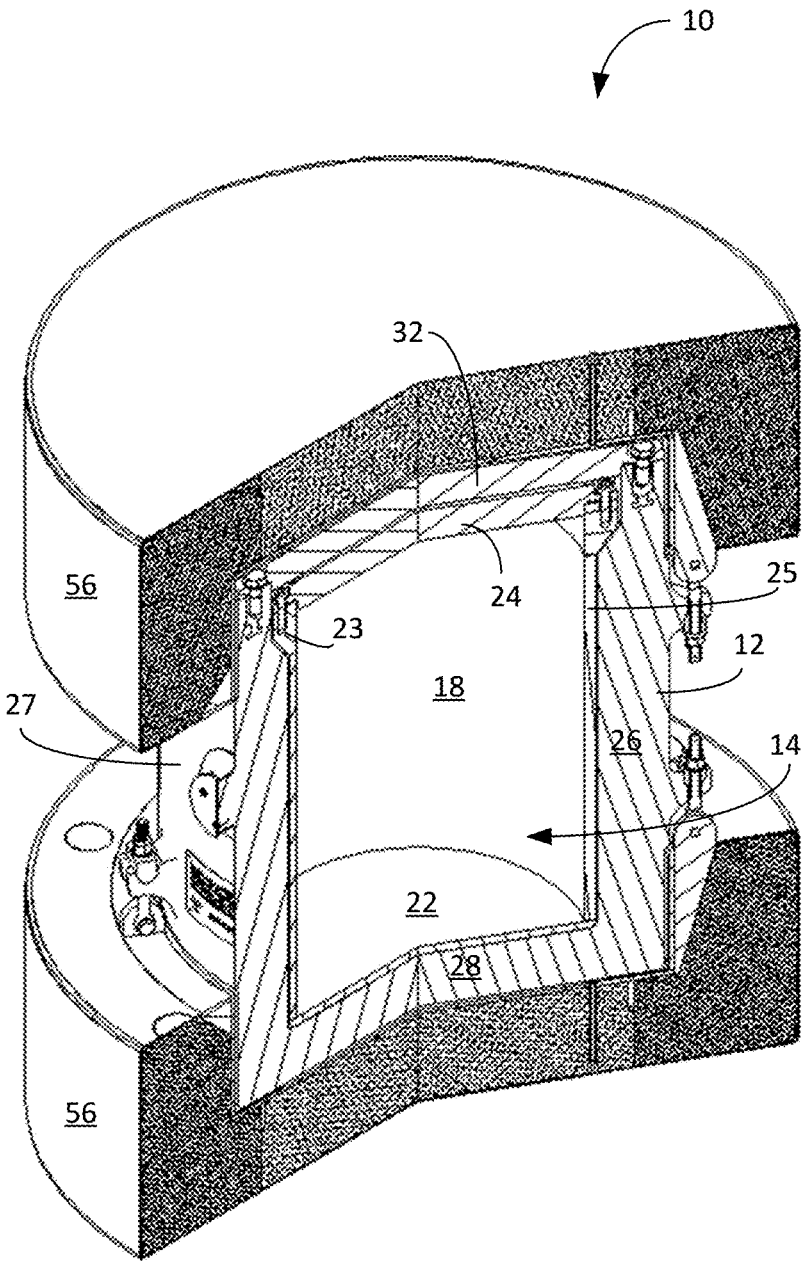
FIG. 1 is a perspective view of a first embodiment of a cask, with cutaway showing an outer shield vessel (OSV; outer container) that contains a common containment vessel (CCV) that is designed to contain a single drum having radioactive hazardous waste.
Figure 9C:
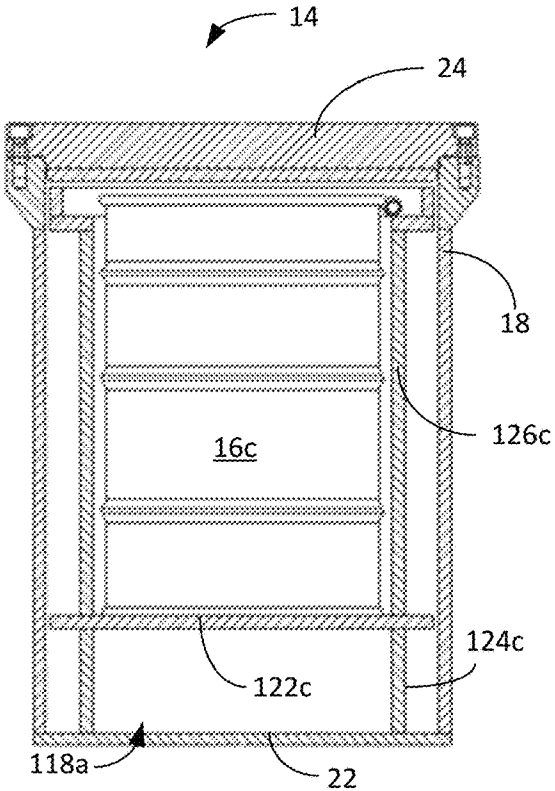
FIG. 9A through 9C are cross sectional views of the CCV of FIG. 7 containing different size drums having radioactive hazardous waste by using a different size payload liner for each.

FIG. 1 is a perspective view of a first embodiment of a containment cask, denoted by reference numeral 10, with cutaway showing an outer shield vessel 12 (OSV; outer container) that contains a common containment vessel (CCV) 14 that is designed to contain a single stainless steel drum 16 (FIG. 9) having radioactive hazardous waste, including but not limited to, non-compliant remote handled transuranic (RH-TRU) waste (e.g., RH-TRU waste containing items that are not permitted by the waste isolation pilot plate (WIPP) acceptance criteria, such as aerosol cans, small liquid containers, etc.), Canada deuterium uranium (CANDU) waste, radioactive debris, experimental spent nuclear fuel, irradiated fissile materials, nuclear fuel debris, high level waste (HLW), greater than Class C waste (GTCC), etc. The drum 16 can be any one of the following: a U.S. standard 110-gallon drum 16*a* (FIG. 9A), 85-gallon drum 16*b* (FIG. 9B), or 55-gallon drum 16*c* (FIG. 9C). The design of the containment cask 10 is simple and low cost. The first embodiment of the containment cask 10 is designed with more shielding than the second embodiment, which will be described in detail later in this document, in order to handle drums having higher radioactive waste content.

The CCV 14 has an elongated cylindrical body 18 extending between a top end and a bottom end. The CCV body includes a cylindrical side wall 25, a planar bottom plate 22 at the bottom end and welded to the side wall 25, a flared bolt flange 23 with an open top welded to the side wall 25 at the top end, and a circular planar lid 24 mounted to the top of the flared bolt flange 23 and over the open top. The side wall 25, the bottom plate 22, the flared bolt flange 23, and the lid 24, together in combination, define an interior region that contains the single drum 16 and provides leak-tight containment of the radioactive materials within the CCV 14. The CCV 14 is made from stainless steel and is the primary shielding mechanism for the contained drum 16. When in use for transport and storage, the CCV 14 is in a completely sealed configuration.

Figure 2:
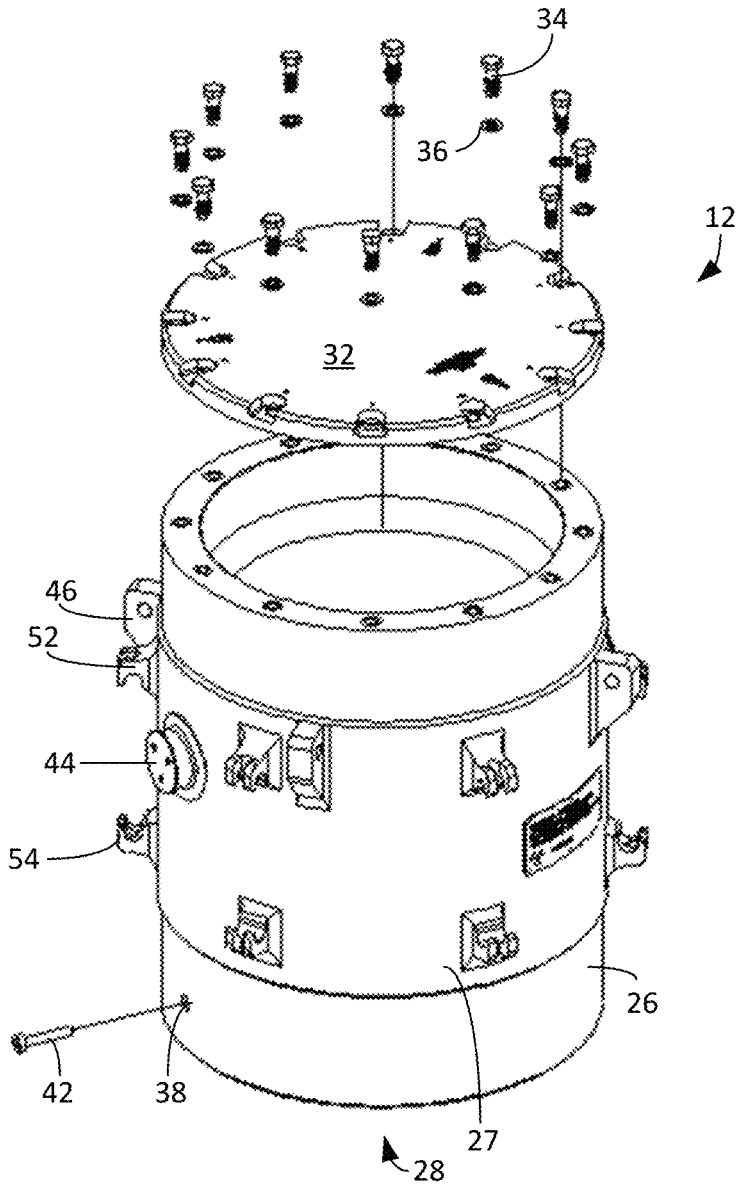
FIG. 2 is an exploded view of the OSV of FIG. 1.

FIG. 2 is an exploded view of the OSV 12. The OSV 12 has an elongated cylindrical OSV body 26 extending between a top end and a bottom end. The OSV body 26 includes a side wall 27, a planar bottom plate 28 at the bottom end that is integral to the side wall 27, and a circular planar lid 32 mounted to the side wall 27 at the top end and over the open top of the OSV 12. The OSV body 26 defines an interior region that contains the CCV 14 having the single drum 16 containing the radioactive hazardous waste. The OSV 12 is not a pressure maintaining assembly, but merely a structure to protect the CCD 14 from external events, such as potential drops, punctures, fire, etc.

The OSV 12 comprises supplemental shielding required to reduce the external radiation dose rates to acceptable levels. In the preferred embodiment, the side wall 27, bottom plate 28, and lid 32 of the OSV 12 is made from ductile cast iron. In the preferred embodiment, the thickness of the iron side wall 27 is (a) about 7 inches between the impact limiters 56, (b) about 6.5 inches where the impact limiters 56 overhang the ends of the OSV, and (c) about 6 inches at the bottom end. The containment cask 10 can be used to transport and store a drum 16 having RH-TRU waste and/or irradiated fuel waste. Moreover, RH-TRU and irradiated fuel waste can exhibit a decay heat of no greater than 200 Watts and 1500 Watts, respectively.

The lid 32 at the top end is bolted to the OSV body 26 via a plurality of alloy steel bolts 34 with steel washers 36 and an elastomeric gasket weather seal to prevent water intrusion. Alignment pins are also used to facilitate OSV lid alignment and installation operations.

The OSV 12 includes one or more drain ports 38, preferably one, with corresponding drain port plugs 42 for enabling and disabling drainage. The drain port 38 is provided to allow the OSV cavity to be checked for the presence of liquids, and drained if needed, during storage or site operations. The drain port may also be used for continuous monitoring, if required by the site and/or the governing regulations. The drain port 38 can enable free draining, when the containment cask 10 is in storage mode, to prevent trapping of water in the interior region of the OSV 12 that is outside of the sealed CCV 12.

A plurality of diametrically opposed lifting trunnions 44 are positioned on opposing sides and extend outwardly from the surface of the OSV body 26 to enable vertical handling of the containment cask 10 and securing of the containment cask 10. The lifting trunnions 44 are cast into the OSV body, are a simple lift yoke design that can be operated without special equipment, and comply with ANSI-N14.6 industry standards. The lifting trunnions 44 can also be used to tie down the containment cask 10 for transport.

A plurality of tie-down lugs 46 are also positioned to extend outwardly from the surface of the OSV body 26 to enable the containment cask 10 to be secured. As an example, the tiedown lugs 46 enable the containment cask 10 to be secured to a trailer bed. Because of the light weight of the containment cask 10 (i.e., CCV weight of between 2650 lb. and 6200 lb. and gross cask weight of between 26,100 lb. and 30,000 lb.), up to 3 of the containment casks 10 can be shipped per road shipment, and the tie down arms 46 can be used to secure them to a trailer bed.

The OSV 12 includes a plurality of upper impact limiter attachment lugs 52 extending outwardly from the OSV body 26 so that an upper impact limiter 56 can be situated at the top end of the OSV 12. The OSV 12 further includes a plurality of lower impact limiter attachment lugs 56 extending outwardly from the OSV body 26 so that a lower impact limiter 56 can be situated at the bottom end of the OSV 12. In the preferred embodiment, each of the upper and lower impact limiters 56 are identical in construction.

Figure 3:
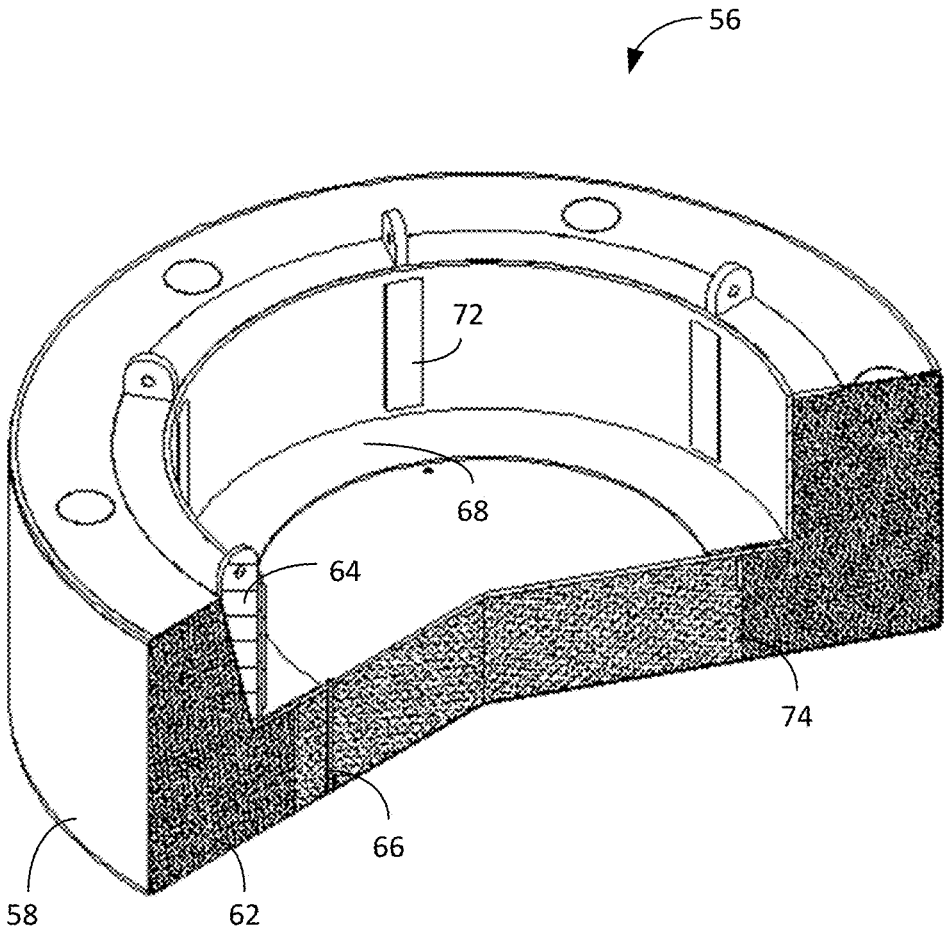
FIG. 3 is a perspective view of an impact limiter (upper and/or lower) situated at the top and bottom ends of the OSV of FIGS. 1 and 2, with a cutaway showing a stainless steel shell encapsulating a rigid polyurethane foam.

The impact upper and lower impact limiters 56 are symmetric and interchangeable. As shown in FIG. 3, each impact limiter 56 has a pocket on the inside that fits over the respective end of the OSV 12. Each impact limiter 56 has a stainless steel shell 58 encapsulating a rigid polyurethane foam 62. In the preferred embodiment, the shell has a thickness of about 0.075 inches. Each impact limiter 56 includes a plurality of attachment lugs 64 that engage and attach to attachment lugs 54 (FIG. 2) associated with the OSV 12 using preferably T-bolt type connections. A drain tube 66 enables water to exit the annular gap region between the bottom impact limiter 56 and the OSV 12. For the top impact limiter 56, the drain tube 66 is capped to prevent water intrusion. A bottom rub ring 68 and a plurality of radial rub strips 72 are designed to engage the outside of the OSV 12. A shear ring 74 provides a shearing effect, if needed. Other suitable types of impact limiters are known and could be utilized instead of the one associated with the preferred embodiment.

In the preferred embodiment, the containment cask 10 measures about 74.5 inches in diameter and about 84.5 inches in vertical height. Moreover, the robust design enables storage of the containment cask 10 in an existing building or outdoors.

B. Second Embodiment of Containment Cask

Figure 4:
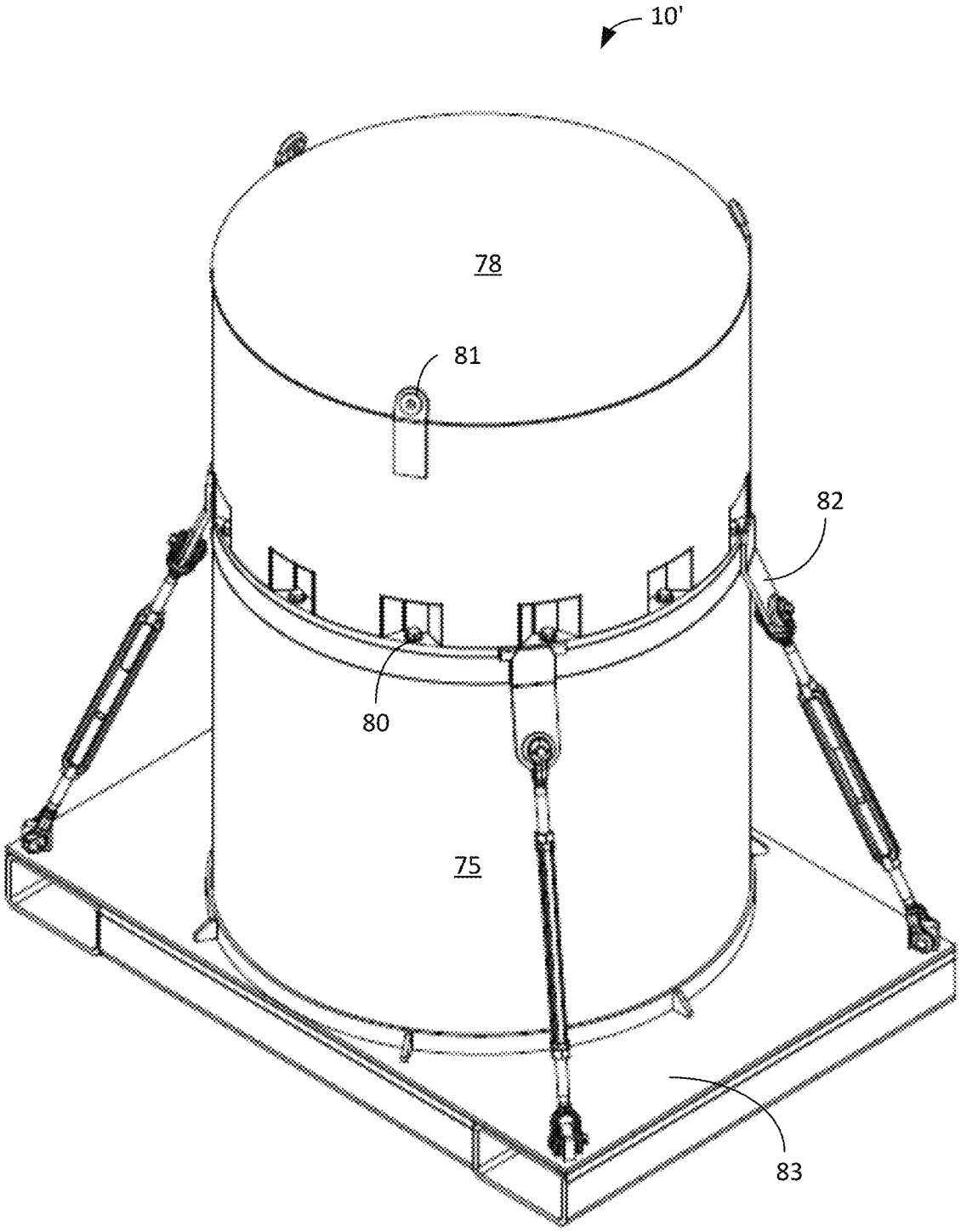
FIG. 4 is a perspective view of a second embodiment of the cask, showing an unsheilded overpack assembly that contains the CCV of FIG. 1 that is designed to contain a single drum having radioactive hazardous waste.
Figure 5:
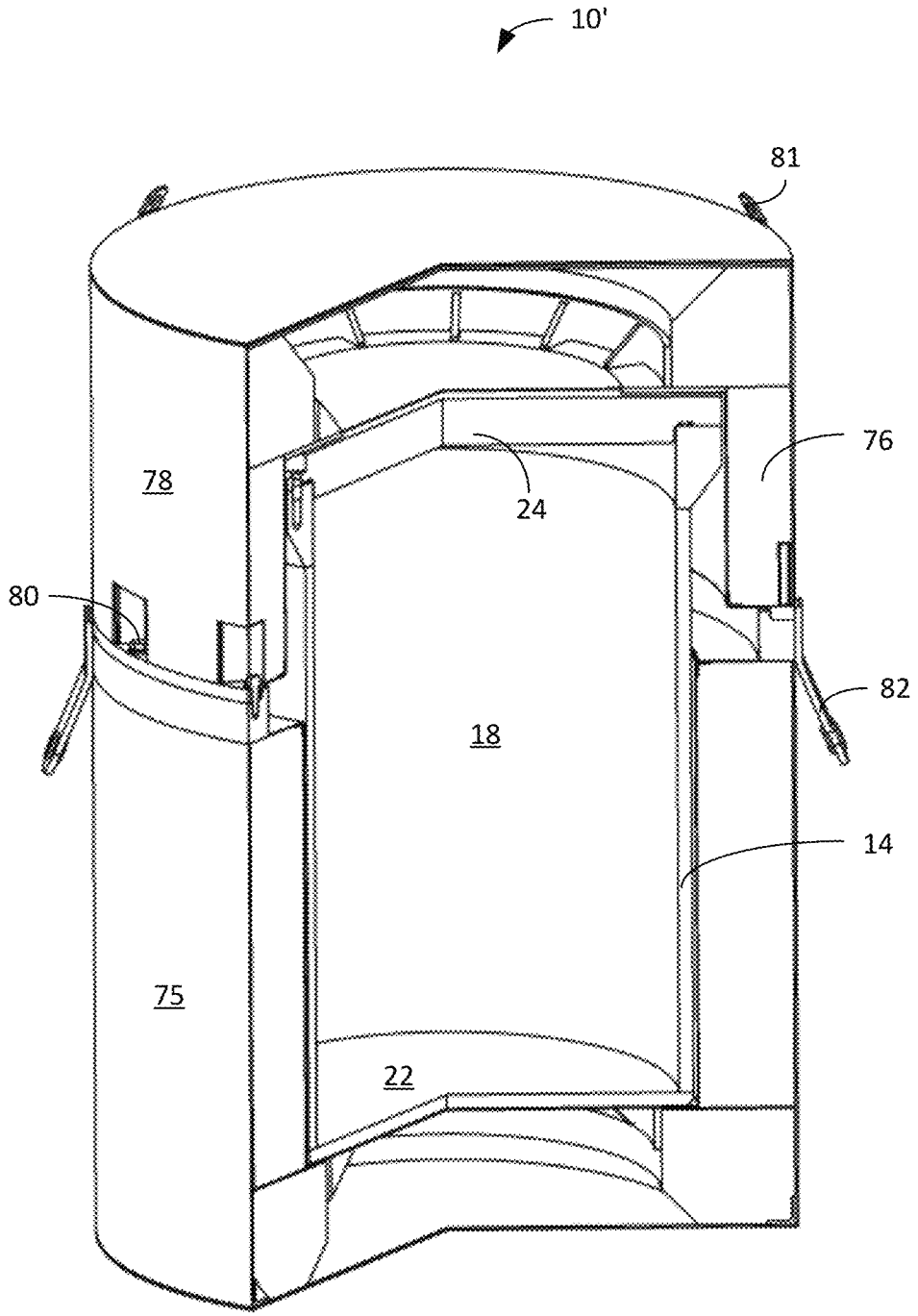
FIG. 5 is a perspective view of the second embodiment of the cask of FIG. 4, with cutaway showing an outer container (unshielded overpack) that contains the CCV of FIG. 1.
Figure 6:
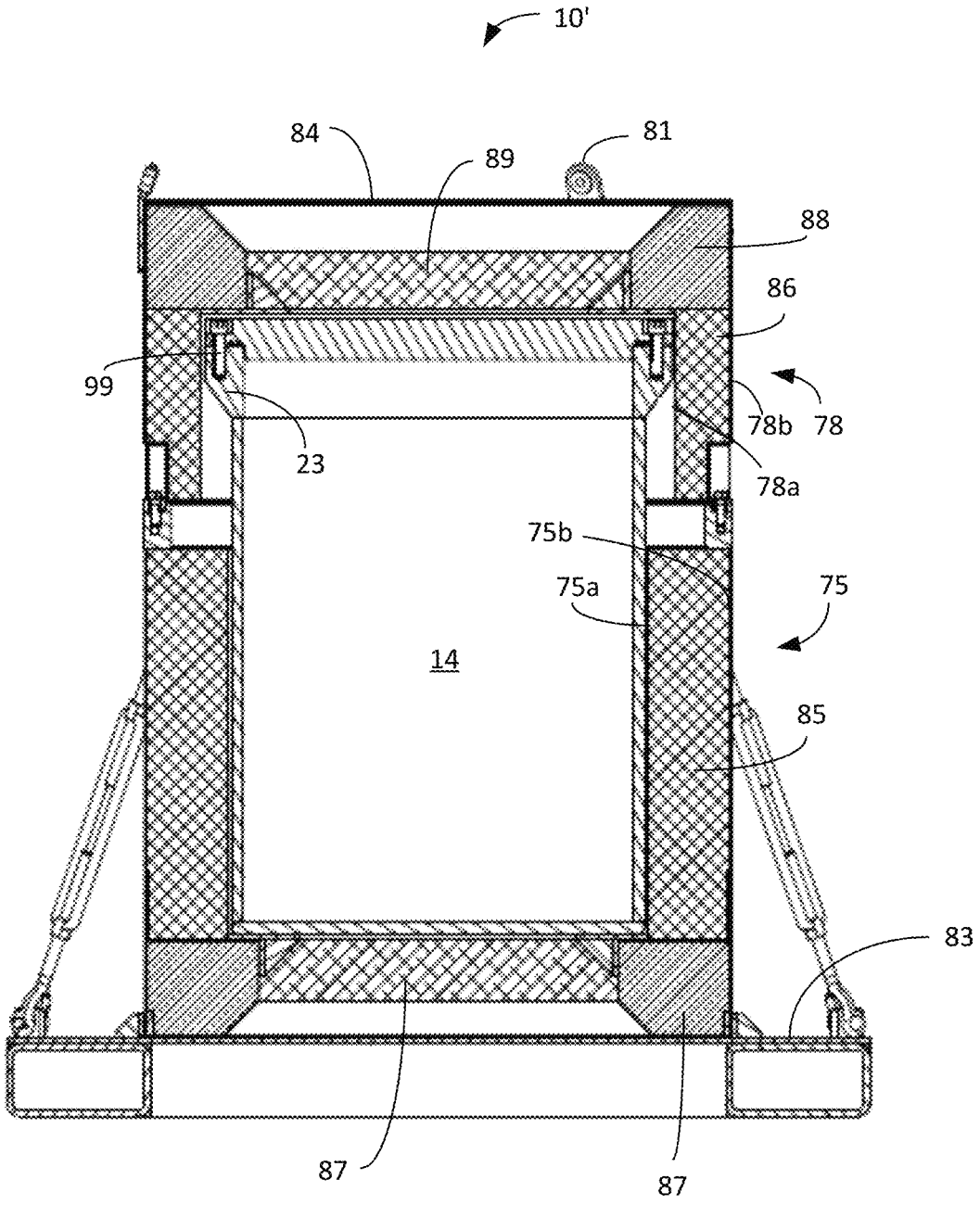
FIG. 6 is a section view of the second embodiment of the cask of FIG. 4

A second embodiment of the containment cask, denoted by reference numeral 10', will now be described with reference to FIGS. 4 through 6. The containment cask 10' (second embodiment) is designed to be smaller and lighter in terms of weight than the containment cask 10 (first embodiment) in order to maximize the number of containment casks that can be transported in a single consignment. FIG. 4 is a perspective view of the containment cask 10'. FIG. 5 is a perspective view of the second embodiment with cutaway showing an unshielded overpack assembly 76 (outer container) that contains the CCV 14 (FIG. 1) that is designed to contain a single drum 16 (FIG. 7) having radioactive hazardous waste, for example, contact handled transuranic (CHTRU) waste that exhibits a decay heat no greater than 200 Watts. FIG. 6 is a cross sectional view of the containment cask 10'. The overpack assembly 76 generally provides minimal supplemental shielding to assist with the primary shielding provided by the CCV 14.

The overpack assembly 76 has a cylindrical base assembly 75 that is covered by a cylindrical lid assembly 78. The lid assembly 78 is bolted to the base assembly 75 via a plurality of equally spaced bolts 80 to secure the CCV 18 within its internal cavity. The base assembly 75 and lid assembly 78 are generally made of stainless steel shells that are filled with rigid polyurethane foam. There is flexibility in connection with the shielding. Shielding inserts can be optimized for different contents, eliminating the need to repackage some drums that have non-compliant TRU waste and thereby resulting in fewer shipments.

The lid assembly 78 has a plurality of lifting tabs 81 to enable vertical handling of the lid assembly 78 and loaded package 10' using standard rigging. The base assembly 75 is equipped with a plurality of tie down arms 82 to enable the overpack assembly 76 (and containment cask 10') to be secured to a support structure 83. Because of the light weight of the packaging 10' and contents (i.e., CCV weight of about 3100 lbs. and gross cask weight between about 6,000 lb. to 8,200 lb.), up to 10 of the containment casks 10' can be shipped per road shipment, and the tie down arms 82 can be used to secure them to a trailer bed.

As shown in FIG. 6, the overpack assembly 76, when assembled, has an elongated cylindrical body extending between a top end and a bottom end. There is a planar bottom plate 83 at the bottom end that is welded to the body of the base assembly 75, and there is a planar top plate 84 at the top end that is welded to the body of the lid assembly 78.

As for foam inserts, the sides of the base assembly 75 has outer and inner stainless steel shells 75*a*, 75*b* with side foam 85 between them. The sides of the lid assembly 78 also has outer and inner stainless steel shells 78*a*, 78*b* with side foam 86 between them. The bottom end of the base assembly 75 includes corner foam 87 and center foam 87. A thermal spider may also be situated in the center foam 87 for heat dissipation. The top end of the lid assembly 78 includes corner foam 88 and center foam 89. The thickness of the outer and inner shells are designed for optimal crushing properties, and in the preferred embodiment, are 3/16 inches and 14 gauge, respectively.

In terms of dimensions, in the preferred embodiment, the containment cask 10' measures about 47 inches in diameter and about 64.5 inches in vertical height.

C. Common Containment Vessel (CVV)

Figure 7:
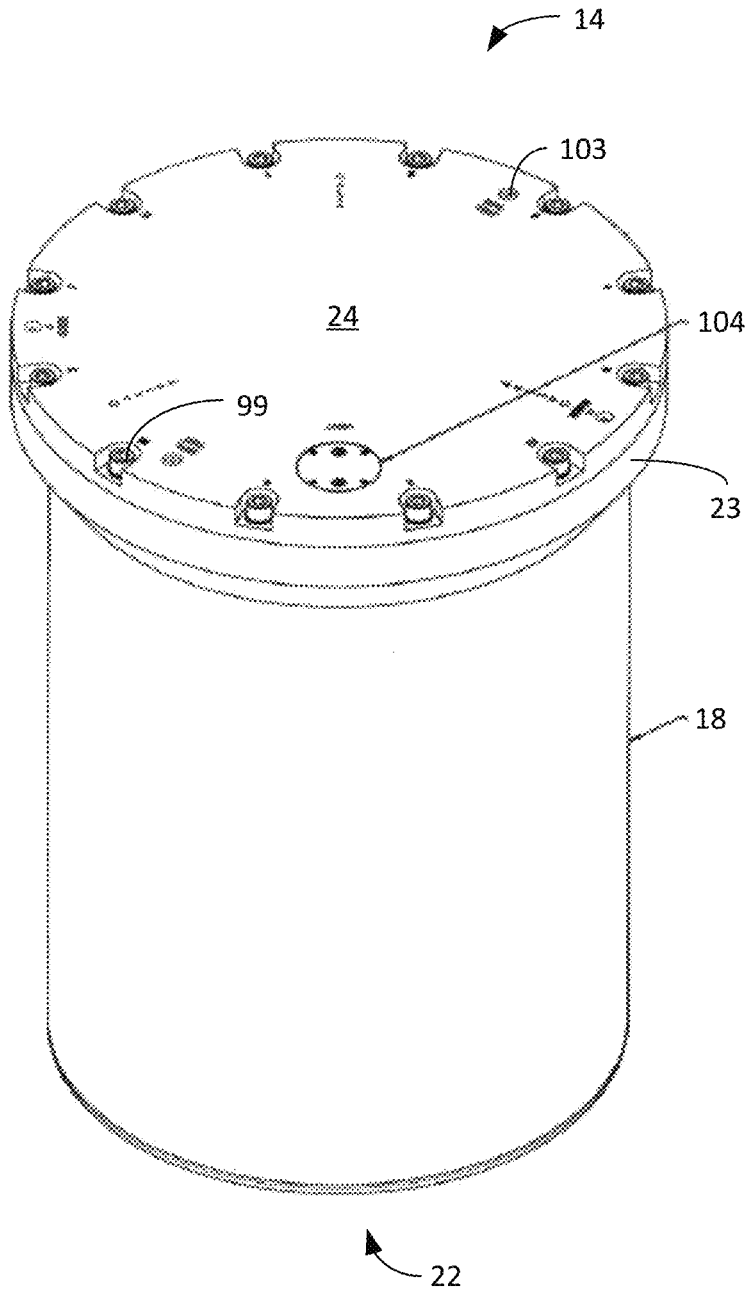
FIG. 7 is a perspective view of the CCV of FIGS. 1 and 4 associated with the first and second embodiments, respectively.
Figure 8:
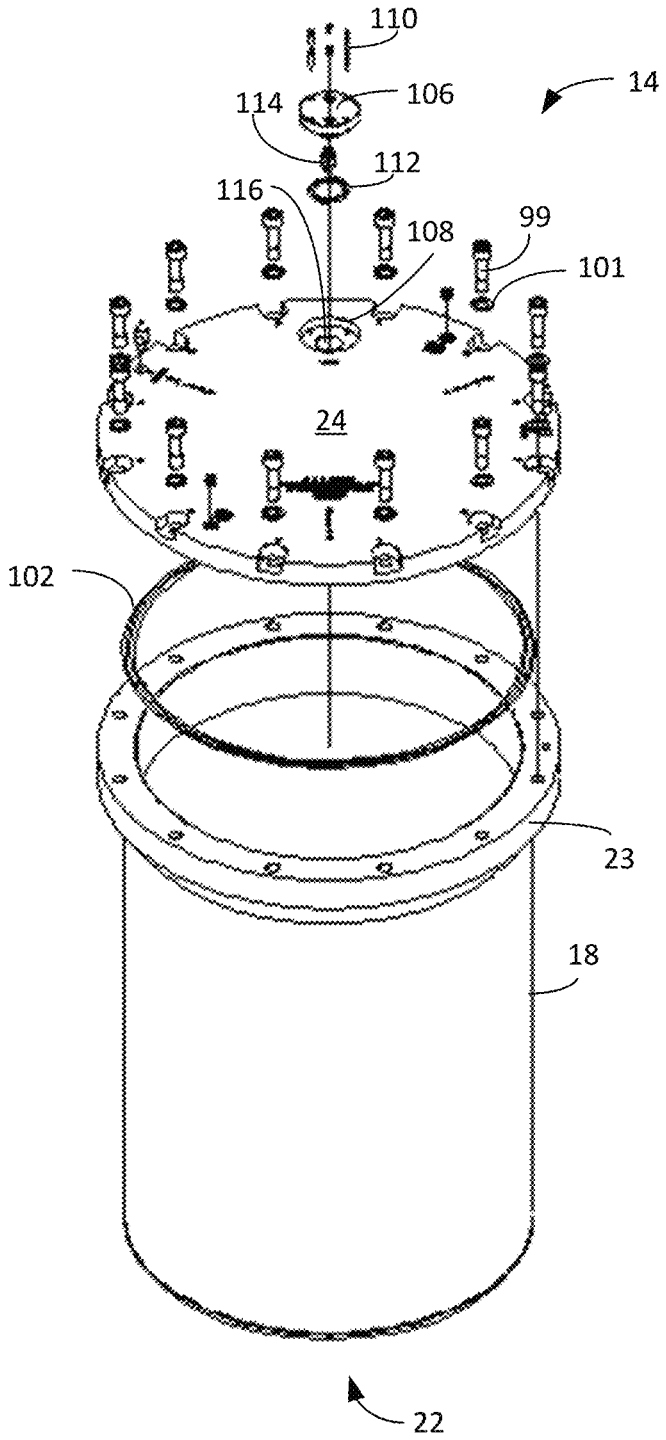
FIG. 8 is an exploded view of the CCV of FIGS. 1 and 6.

FIG. 7 is a perspective view and FIG. 8 is an exploded view of the CCV 14 (of FIGS. 1 and 4) that is stored within the first and second embodiments of the containment cask 10, 10'. As shown in FIGS. 7 and 8, the CCV 14 has an elongated cylindrical body 18 extending between a top end and a bottom end. The CCV body includes a cylindrical side wall 18, a planar bottom plate 22 at the bottom end and welded to the side wall 18, a flared bolt flange 23 with an open top welded to the side wall 18 at the top end, and a circular planar lid 24 mounted to the top of the flared bolt flange 23 and over the open top. The side wall 18, the bottom plate 22, the flared bolt flange, and the lid 24, together in combination, define an interior region that contains the single drum 16 and provides sufficient shielding to contain radiation within the CCV 14. In the preferred embodiment, the drum 16 can have a fissile gram equivalent (FGE; i.e., grams of plutonium 239) up to 390.

The lid 24 is mounted to the flared bolt flange 23 via a plurality of captured closure bolts 99 with corresponding washers 101. The captured bolts 99 facilitate remote lid installation and removal operations that are required for certain payloads. Alignment pins are used to facilitate CCV lid alignment and installation operations. A plurality of spaced-apart, concentric O-rings 102 (elastomeric gasket weather seal; inner for containment; outer for test) are situated between the lid 24 and the bolt flange 23 of the CCV 14. A plurality of threaded holes 103 in the lid 24 enable the CCV 14 to be vertically lifted and lowered using standard rigging (wires ropes, shackles, swivel hoist rings). In the preferred embodiment, the CCV 14 has a diameter of about 32.5 inches and a vertical height of about 47.38 inches.

The CCV 14 includes a test port assembly 104 that can be used to test the sealing capability (vent and leak) of the CCV 14 using known techniques. In essence, the test port assembly 104 is used to evacuate the CCV 14, backfill the CCV 14 with an inert gas, such as Helium, and then check for leaks. The test port assembly 104 has a port cover 106 that is mounted within a circular lid aperture 108 via a plurality of port cover bolts 110. Dual O-rings 112 (inner for containment; outer for test) are used between the port cover 106 and a donut shaped bottom associated with the circular lid aperture 108. A quick connect valve 114 is mounted over a circular lid hole 116 to enable access to the inner atmosphere of the CCV 14. The quick connect valve 114 is accessed by removing the port cover 106.

One or more modular supplemental shields may be added to the CCV 14, or a separate shield liner (e.g., the payload liner described later) may be added to the interior cavity of the CCV 14. These additional shields may be added as liners to the CCV 14. Each shield can be optimized for a specific set or type of radioactive hazardous waste.

D. Payload Liner

Depending on the size and shielding requirements of the various payloads, a payload liner may be used inside the CCV cavity to shore the contents within the CCV cavity and provide additional shielding. A payload liner may be made from various materials and sizes, depending on the type and amount of shielding that is required.

Figure 9B:
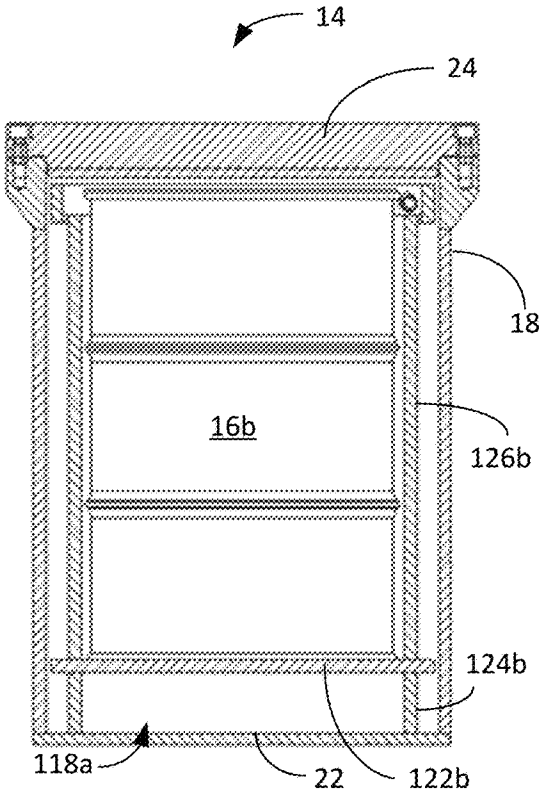
Figure 9A:
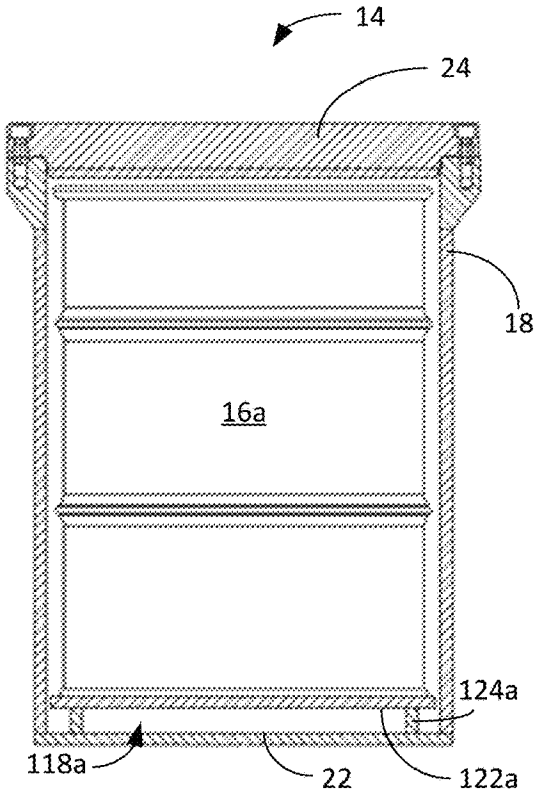

FIGS. 9A, 9B, and 9C are cross sectional views of the CCV 14 containing different size drums 16*a*, 16*b*, and 16*c*, respectively, having radioactive hazardous waste by using different size payload liners 118*a*, 118*b*, and 118*c*, respectively. Specifically, FIG. 9A shows a U.S. standard 110-gallon drum 16*a*. FIG. 9B shows a U.S. standard 85-gallon drum 16*b*. FIG. 9C shows a U.S. standard 55-gallon drum 16*c*.

With reference to FIG. 9A, the payload liner 118*a* has a circular platform 122*a* upon which the drum 16*a* rests. A cylindrical lower part 124*a* with a cylindrical internal region supports the platform 122*a* over the bottom plate 22 of the CCV 14.

Referring to FIG. 9B, the payload liner 118*b* has an elongated body having a top part 126*b* with a cylindrical internal region, a lower part 124*b* with a cylindrical internal region, and a circular planar platform 122*b* between and separating the top and lower parts 126*b*, 124*b*. The cylindrical lower part 124*b* supports the platform 122*b* over the bottom plate 22 of the CCV 14. The drum 16*b* is contained in the internal region of the top part 124*b* between the top of the CCV 14 and the platform 122*b* of the liner 118*b*. The top part 126*b* is also designed to generally center the single drum 16*b* within the CCV 14 along a vertical axis extending between the top end and the bottom end of the CCV 14.

Referring to FIG. 9C, the payload liner 118*c* has an elongated body having a top part 126*c* with a cylindrical internal region, a lower part 124*c* with a cylindrical internal region, and a circular planar platform 122*c* between and separating the top and lower parts 126*c*, 124*c*. The cylindrical lower part 124*c* supports the platform 122*c* over the bottom part 22 of the CCV 14. The drum 16*c* is contained in the internal region of the top part 124*c* between the top of the CCV 14 and the platform 122*c* of the liner 118*c*. The top part 126*c* is also designed to generally center the single drum 16*c* within the CCV 14 along a vertical axis extending between the top end and the bottom end of the CCV 14.

The payload liner 118 may be made from a variety of different materials. In some embodiments, the payload liner 118 may comprise supplemental shielding to assist with containing the radioactive hazardous waste within the drum 16. In one embodiment, among others, the payload liner 118 is made of stainless steel, which is itself, a shielding material. In another embodiment, among others, the payload liner 118 is made from a polyurethane foam, which is not shielding but absorbs neutrons.

E. Fully Assembled First and Second Embodiments of Containment Cask

Figure 10:
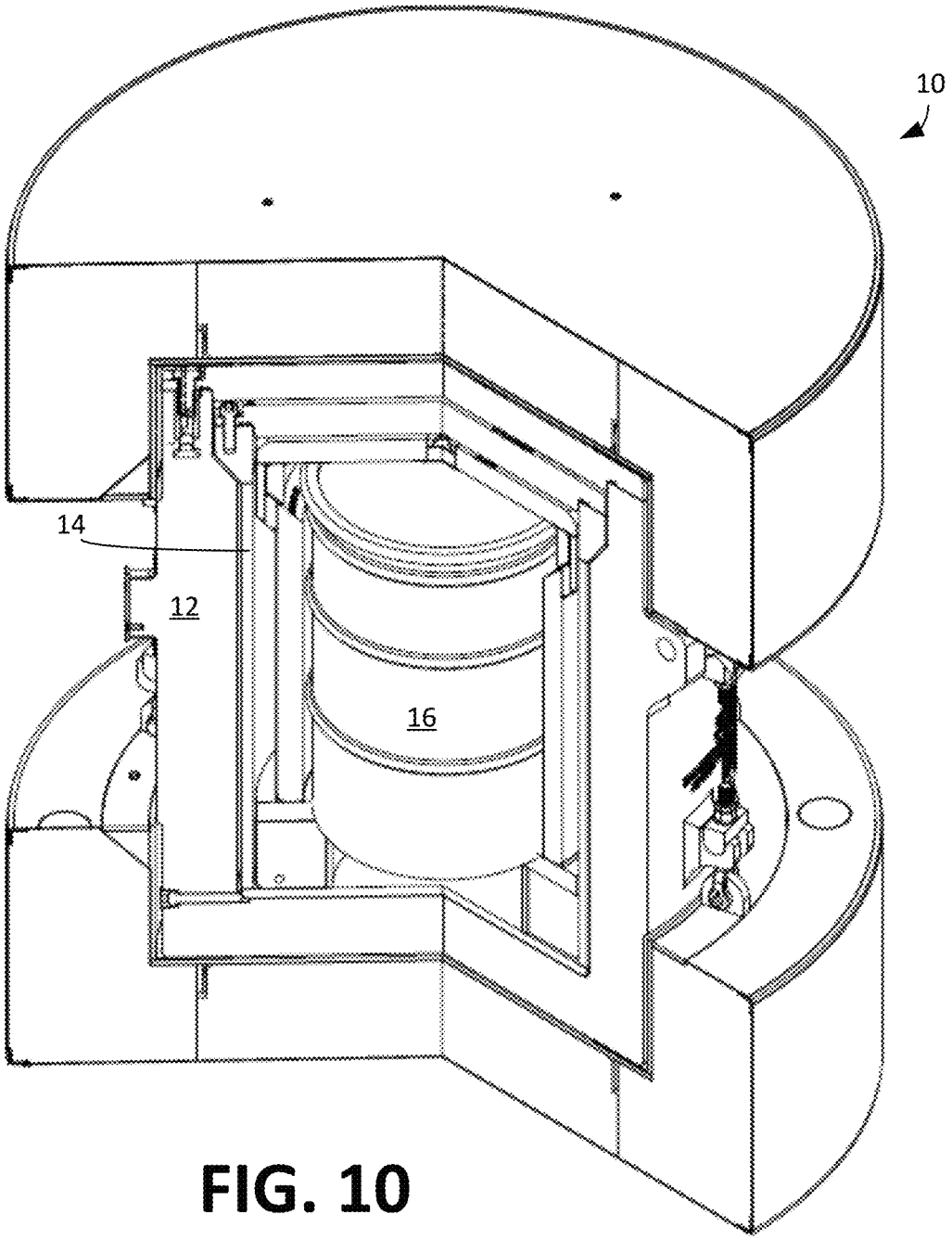
FIG. 10 is a perspective view with cutaway showing the first embodiment of the cask, which has the single drum situated within the containment vessel, which is situated within the outer container.

FIG. 10 is a perspective view with cutaway showing the first embodiment of the cask, denoted by reference numeral 10, which has the single drum 16 situated within the containment vessel 14 (common containment vessel; CCV), which is situated within the outer container 12 (shielded, outer shield vessel; OSV).

Figure 11:
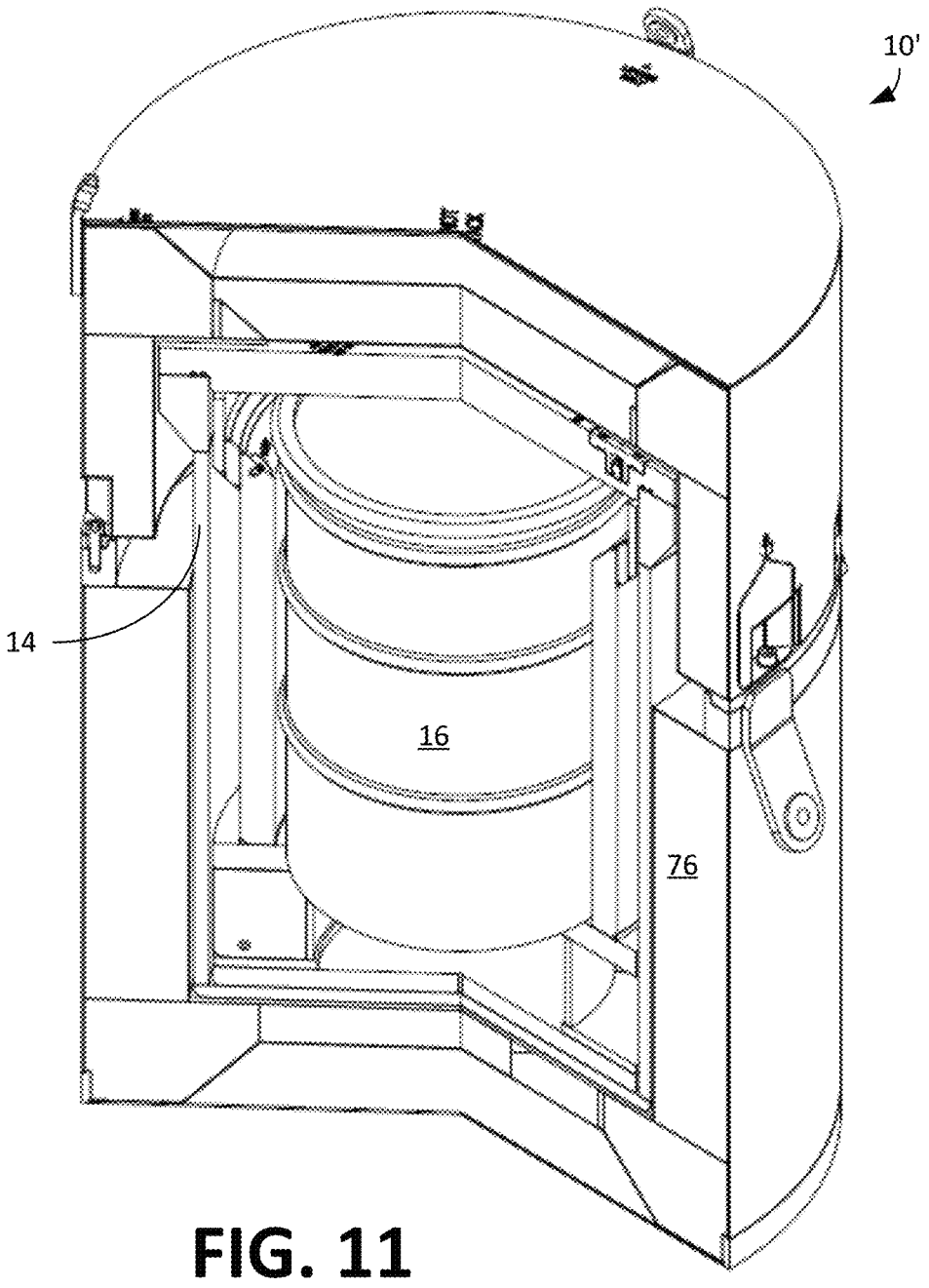
FIG. 11 is a perspective view with cutaway showing the second embodiment of the cask, which has the single drum situated within the containment vessel, which is situated within the outer container.

FIG. 11 is a perspective view with cutaway showing the second embodiment of the cask, denoted by reference numeral 10', which has the single drum 16 situated within the containment vessel 14 (common containment vessel; CCV), which is situated within the outer container 76 (overpack assembly with shielding inserts for shielding flexibility; lighter in weight than the OSV).

F. Variations and Modifications

It should be emphasized that the above-described embodiments of the present invention, particularly, any "preferred" embodiments, are merely possible nonlimiting examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention.

As an example, the containment casks 10 and 10' can accommodate drum sizes that are different than those described.

As another example, an impact limiter that is different than the impact limiter 56 may be utilized in connection with the OSV 12.

The invention claimed is:

1. A method for designing a containment cask for safely transporting and storing radioactive hazardous waste, the method comprising the steps of:

(a) providing a common containment vessel (CCV), the CCV having an elongated cylindrical body extending between a top end and a bottom end, the body having an elongated cylindrical side wall, a circular planar bottom plate mounted to the side wall at the bottom end, and a circular planar lid mounted to the side wall at the top end, wherein the body defines an interior region that contains a single drum containing the radioactive hazardous waste and provides shielding to inhibit radiation emitted from the single drum;

(b) providing an outer shield vessel (OSV), the OSV having an elongated cylindrical body extending between a top end and a bottom end, the body having an elongated cylindrical side wall, a circular planar bottom plate mounted to the side wall at the bottom end, and a circular planar lid mounted to the side wall at the top end, wherein the body defines an interior region that can contain the CCV having the single drum containing the radioactive hazardous waste, the OSV comprising supplemental shielding designed to reduce the external radiation dose rates from the radioactive hazardous waste within the drum, the supplemental shielding comprising ductile cast iron;

(c) providing an overpack assembly, the overpack assembly being lighter in weight than the OSV, the overpack assembly having an elongated cylindrical body extending between a top end and a bottom end, the body having an elongated cylindrical side wall, a circular planar bottom plate mounted to the side wall at the bottom end, and a circular planar lid mounted to the side wall at the top end, wherein the body defines an interior region that contains the CCV having the single drum containing the radioactive hazardous waste, the overpack assembly having shielding inserts that inhibit nuclear radiation, the inserts enabling flexibility in terms of a degree of shielding; and (d) selecting either the OSV or overpack assembly for use in combination with the CCV in order to create the containment cask, based at least in part upon the radioactive hazardous waste contained within the single drum.

2. The method of claim 1, further comprising the step of constructing the containment cask by having the single drum containing the radioactive hazardous waste, placed within the CCV, and then having the CCV containing the single drum placed with the selected one of the OSV or overpack assembly.

3. The method of claim 1, further comprising the step of providing the CCV in substantial part with stainless steel.

4. The method of claim 1, further comprising the step of providing each of the OSV and the overpack assembly with one or more drains so that the OSV and overpack assembly are each free draining to prevent trapping of water.

5. The method of claim 1, further comprising the step of providing the OSV with upper and lower impact limiters situated at the top and bottom ends, respectively, the upper and lower impact limiters each comprising a stainless steel shell encapsulating a rigid polyurethane foam.

6. The method of claim 5, further comprising the step of providing the OSV with a plurality of trunnions extending outwardly from the body of the OSV to enable vertical handling of the cask and securing of the cask.

7. The method of claim 1, further comprising the step of providing each of the OSV and the overpack assembly with the following:

a payload liner within the CCV, the liner having an elongated body having a top part with a cylindrical internal region, a lower part with a cylindrical internal region, and a planar platform between and separating the top and lower parts;

wherein the single drum is contained in the internal region of the top part between the top of the CCV and the platform of the liner; and wherein the top part generally centers the single drum within the CCV along a vertical axis extending between the top end and the bottom end of the CCV.

8. The method of claim 7, further comprising the step of providing the payload liner with supplemental shielding to reduce the external dose rates from the radioactive hazardous waste within the drum.

9. The method of claim 1, further comprising the step of providing, as the single drum, one of the following standard sizes: 110 gallon, 85 gallon, and 55 gallon.

10. The method of claim 1, further comprising the step of providing the CCV with the following:

a plurality of bolts attaching the lid to the body of the containment vessel; and a plurality of spaced-apart, concentric O-rings between the lid and body of the containment vessel.

11. The method of claim 1, further comprising the step of providing the CCV with a test port for testing ventilation and leaking characteristics.

12. The method of claim 1, further comprising the step of providing the body of the CCV with a bolt flange at the top end, the bolt flange being flared outwardly from the side wall and the lid mounted to the bolt flange at the top end.

13. A method for designing a containment cask for safely transporting and storing radioactive hazardous waste, the method comprising the steps of:

(a) providing a common containment vessel (CCV), the CCV having an elongated cylindrical body extending between a top end and a bottom end, the body having an elongated cylindrical side wall, a circular planar bottom plate mounted to the side wall at the bottom end, and a circular planar lid mounted to the side wall at the top end, wherein the body defines an interior region that contains a single drum containing the radioactive hazardous waste and provides shielding to inhibit radiation emitted from the single drum; and (b) selecting either an outer shield vessel (OSV) or overpack assembly for containing the CCV based upon the radioactive hazardous waste contained within the single drum, wherein:

(1) the OSV having an elongated cylindrical body extending between a top end and a bottom end, the body having an elongated cylindrical side wall, a circular planar bottom plate mounted to the side wall at the bottom end, and a circular planar lid mounted to the side wall at the top end, wherein the body defines an interior region that can contain the CCV having the single drum containing the radioactive hazardous waste, the OSV comprising supplemental shielding designed to reduce the external radiation dose rates from the radioactive hazardous waste within the drum, the supplemental shielding comprising ductile cast iron; and (2) the overpack assembly being lighter in weight than the OSV, the overpack assembly having an elongated cylindrical body extending between a top end and a bottom end, the body having an elongated cylindrical side wall, a circular planar bottom plate mounted to the side wall at the bottom end, and a circular planar lid mounted to the side wall at the top end, wherein the body defines an interior region that contains the CCV having the single drum containing the radioactive hazardous waste, the overpack assembly having shielding inserts that inhibit nuclear radiation, the inserts enabling flexibility in terms of a degree of shielding.

14. The method of claim 13, further comprising the step of constructing the cask by having the single drum containing the radioactive hazardous waste, placed within the CCV, and then having the CCV containing the drum placed with the selected one of the OSV or overpack assembly.

15. A method for constructing a containment cask for safely transporting and storing radioactive hazardous waste, the method comprising the steps of:

(a) constructing a common containment vessel (CCV), the CCV having an elongated cylindrical body extending between a top end and a bottom end, the body having an elongated cylindrical side wall, a circular planar bottom plate mounted to the side wall at the bottom end, and a circular planar lid mounted to the side wall at the top end, wherein the body defines an interior region that contains a single drum containing the radioactive hazardous waste and provides shielding to inhibit radiation emitted from the single drum; and (b) selecting and constructing either an outer shield vessel (OSV) or overpack assembly for containing the CCV based upon the radioactive hazardous waste contained within the single drum, wherein:

(1) the OSV having an elongated cylindrical body extending between a top end and a bottom end, the body having an elongated cylindrical side wall, a circular planar bottom plate mounted to the side wall at the bottom end, and a circular planar lid mounted to the side wall at the top end, wherein the body defines an interior region that can contain the CCV having the single drum containing the radioactive hazardous waste, the OSV comprising supplemental shielding designed to reduce the external radiation dose rates from the radioactive hazardous waste within the drum, the supplemental shielding comprising ductile cast iron; and (2) the overpack assembly being lighter in weight than the OSV, the overpack assembly having an elongated cylindrical body extending between a top end and a bottom end, the body having an elongated cylindrical side wall, a circular planar bottom plate mounted to the side wall at the bottom end, and a circular planar lid mounted to the side wall at the top end, wherein the body defines an interior region that contains the CCV having the single drum containing the radioactive hazardous waste, the overpack assembly having shielding inserts that inhibit nuclear radiation, the inserts enabling flexibility in terms of a degree of shielding; and (c) constructing the cask by having the single drum containing the radioactive hazardous waste, placed within the CCV, and then having the CCV containing the drum placed with the selected one of the OSV or overpack assembly.

16. The method of claim 15, further comprising the step of constructing each of the OSV and the overpack assembly with the following:

a payload liner within the CCV, the liner having an elongated body having a top part with a cylindrical internal region, a lower part with a cylindrical internal region, and a planar platform between and separating the top and lower parts;

wherein the single drum is contained in the internal region of the top part between the top of the CCV and the platform of the liner; and wherein the top part generally centers the single drum within the CCV along a vertical axis extending between the top end and the bottom end of the CCV.

17. The method of claim 16, further comprising the step of constructing the payload liner with supplemental shielding to reduce the external dose rates from the radioactive hazardous waste within the drum.

18. The method of claim 15, further comprising the step of providing, as the single drum, one of the following standard sizes: 110 gallon, 85 gallon, and 55 gallon.

19. The method of claim 15, further comprising the step of constructing the CCV in substantial part with stainless steel.

20. The method of claim 15, further comprising the step of constructing each of the OSV and the overpack assembly with one or more drains so that the OSV and overpack assembly are each free draining to prevent trapping of water.

* * * * *